United States Patent [19]

Naruo et al.

[11] Patent Number: 4,790,862

[45] Date of Patent: Dec. 13, 1988

[54] AIR CLEANING MACHINE

[75] Inventors: Noboru Naruo, Ibaraki; Syuzo Tokumitsu, Kawanishi; Masao Fukunaga, Shiga; Katsunory Zaizen, Mino, all of Japan

[73] Assignee: Matsushita Electric Industrial Co., Ltd., Osaka, Japan

[21] Appl. No.: 90,665

[22] Filed: Aug. 28, 1987

[30] Foreign Application Priority Data

Aug. 29, 1986 [JP] Japan ..... 61-204074

[51] Int. Cl.[4] ..... B01D 46/46

[52] U.S. Cl. ..... 55/210; 55/270; 55/274; 55/467; 55/DIG. 34

[58] Field of Search ..... 55/210–212, 55/270, 274, DIG. 34, 467, 104, 106

[56] References Cited

U.S. PATENT DOCUMENTS

| | | | |
|---|---|---|---|
| 2,533,339 | 12/1950 | Willenborg | 55/210 |
| 3,237,375 | 3/1966 | Schwarz et al. | 55/106 X |
| 3,516,232 | 6/1970 | Gilbertson | 55/DIG. 34 X |
| 3,950,155 | 4/1976 | Komiyama | 55/210 |
| 4,119,419 | 10/1978 | Passaro et al. | 55/274 X |
| 4,177,045 | 12/1979 | Orel | 55/212 X |

FOREIGN PATENT DOCUMENTS

| | | | |
|---|---|---|---|
| 2032825 | 5/1980 | United Kingdom | 55/212 |

*Primary Examiner*—Kathleen J. Prunner

*Attorney, Agent, or Firm*—Wenderoth, Lind & Ponack

[57] ABSTRACT

An air cleaning machine to be used in houses, offices and so on utilizes an ultraviolet-ray sensor and a gas sensor jointly to combine the characteristics, so that the operation of the appliance becomes extremely smooth. The appliance operates almost immediately especially when a signal from a light is received. If a cigarette is lighted, for example, indoors, the air cleaning machine operates immediately to clean the air, so that the user may actually feel it. When the gas occurs even under the circumstance where the ultraviolet ray does not reach the light sensor, the normal operation is performed, thus allowing the automatic operation to be effected. Accordingly, clean air is normally provided under the optimum circumstance.

9 Claims, 4 Drawing Sheets

AIR CLEANING MACHINE

BACKGROUND OF THE INVENTION

The present invention generally relates to an air cleaning machine to be used in houses, offices and so on.

The conventional air cleaning machine of this type has adsorbent such as activated charcoal or the like filled in the filter portion through which the air is passed by a fan, so that the deodorizing operation is effected (some air cleaning machines are provided with a high-voltage means for catching dust with static electricity or the like, and a filter portion). The air cleaning means detects the gas concentration of the gas to be removed inside the room or the like to automatically start the machine to clean the air.

However, the conventional gas sensor cannot produce an output signal unless the gas to be reacted to reaches the gas sensor through the movement of the air or diffusion in the air. Accordingly, the conventional gas sensor had disadvantages in that 5 minutes or 20 minutes may be taken to start the operation of the appliance after the gas to be removed is generated (the start depending upon the indoor condition, the wind direction, the gas concentration or the like), or 40 to 50 minutes may be taken before the operation. It is an extremely important problem when a faster operation is desired at the early stage.

SUMMARY OF THE INVENTION

Accordingly, an object of the present invention is to provide an air cleaning machine which operates quickly when the air cleaning operation is required to immediately perform the deodorizing operation or catch the dust.

When the air cleaning machines are used in the houses, offices or the like, the main object of using them, i.e., 70 through 80 percent, is to remove cigarette smoke, bad odors. Majority of the rest is to remove, as the main object, odors produced during a cooling operation, offensive odors from gas stoves, petroleum stoves and so on. In these objects, lighter flames, gas-, petroleum-combustion flames or the like are often the physical phenomena for gas production. The air cleaning machine of the present invention uses an ultraviolet-ray sensor for detecting the ultraviolet rays to be produced from the flames to operate the appliance simultaneously with the ignition of the lighter or the like, and combines the conventional gas sensor with it to respond to bad odors produced without flames.

In the above-described means, the ultraviolet sensor is sensitive to the ultraviolet rays from the flames of a match or a lighter, or the combustion flames of city gas, LP (liquid propane) gas. On the other hand, the gas sensor is adapted to detect the gas concentration or the existence of gas.

Accordingly, the ultraviolet-ray sensor immediately transmits a signal upon the arrival of the light so as to operate the appliance. Alternatively automatic operation can be carried through the gas detection by the sensor unless the light reaches the ultraviolet-ray sensor.

BRIEF DESCRIPTION OF THE DRAWINGS

These and other objects and features of the present invention will become apparent from the following description of the preferred embodiments thereof taken with reference to the accompanying drawings, in which.

DETAILED DESCRIPTION OF THE INVENTION

Figure 1:
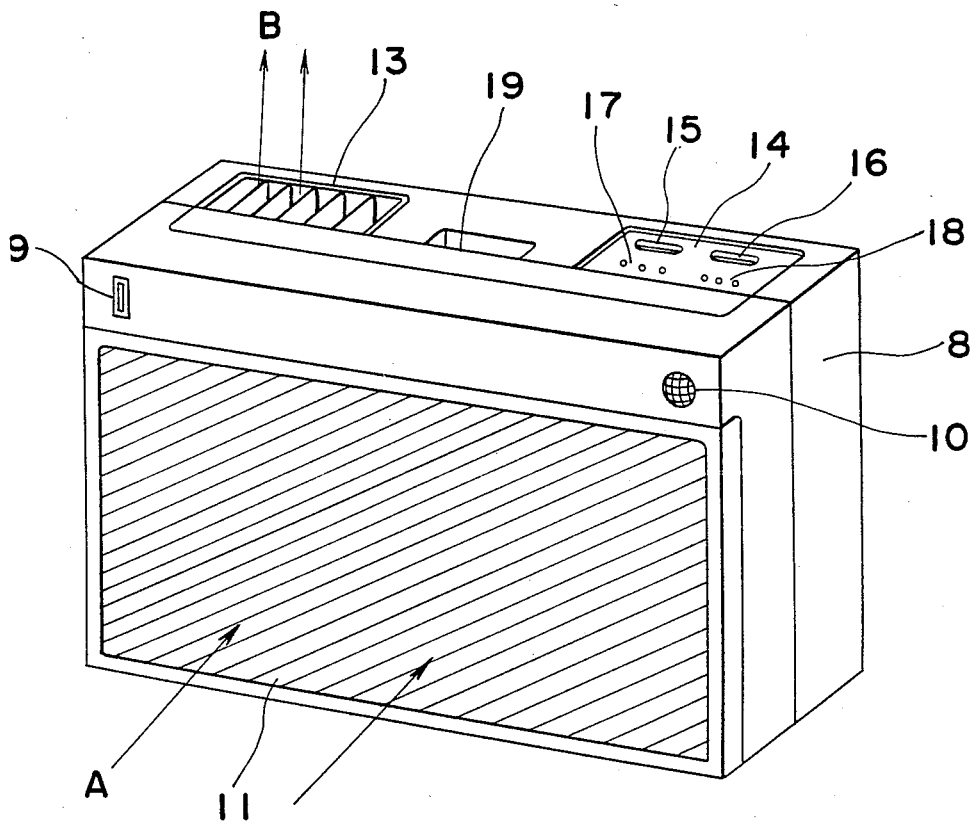
FIG. 1 is a perspective view showing one embodiment of an air cleaning machine of the present invention.

Before the description of the present invention proceeds, it is to be noted that like parts are designated by like reference numerals throughout the accompanying drawings.

Figure 2:
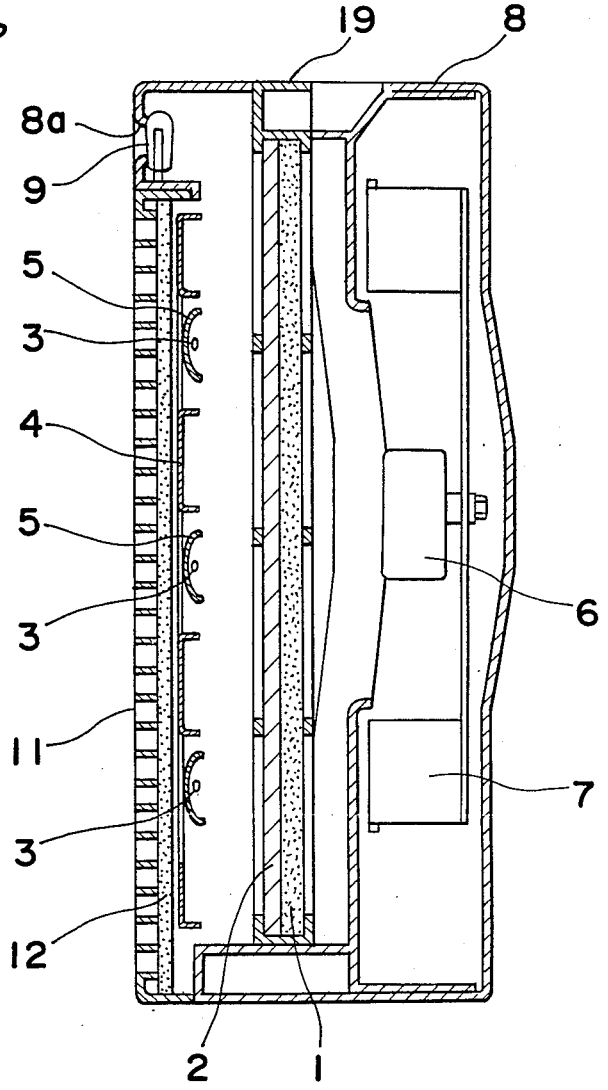
FIG. 2 is a sectional view.
Figure 3:
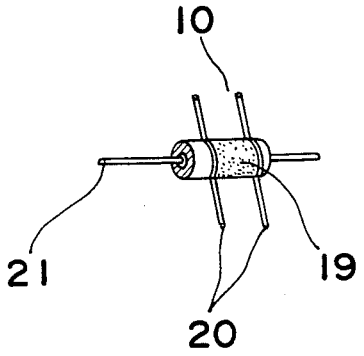
FIG. 3 is a perspective view showing the construction of a gas sensor.
Figure 4:
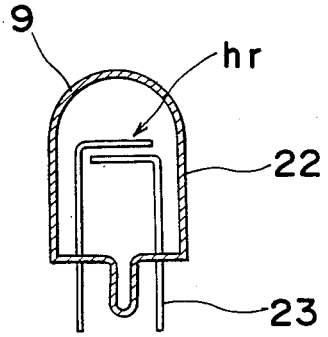
FIG. 4 is a sectional view of an ultraviolet-ray sensor.
Figure 5:
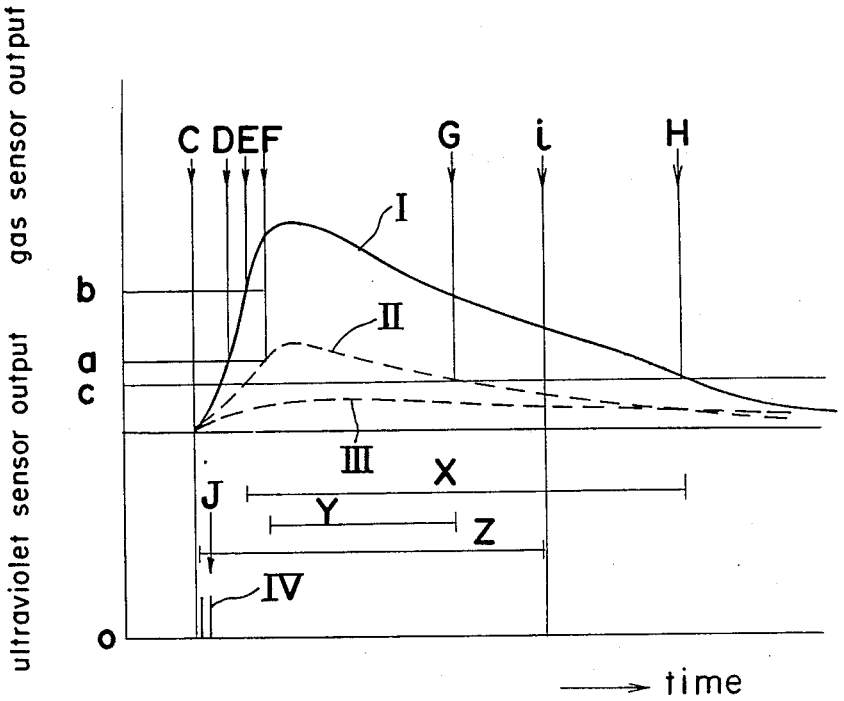
FIG. 5 is a characteristic chart showing the relationship between the sensor output and the time lapse.

Referring now to the drawings, there is shown in FIG. 1 and FIG. 2 the basic construction of an air cleaning machine according to one preferred embodiment of the present invention. The air cleaning machine is composed of a filter portion 1 such as activated charcoal or the like having a deodorizing effect, an electrostatic filter 2, discharge conductors 3 and their corresponding electrodes 4, protective covers 5 for the discharge conductors 3, a fan 7 for moving the air through the filter portion and the discharge-conductor portions, a driving motor 6 for the fan 7, a case 8 with each of the portions being accommodated in it, and so on. The case 8 is provided on its front face with an ultraviolet-ray sensor 9 and a gas sensor 10. Also, a front-face grill 11 and a coarse filter 12 are provided. The case 8 is provided in its upper portion with opening portions 13, so that the polluted air A enters through the front-face grill 11 and is discharged outside from the opening portions 13 as purified clean air B. An operating portion 14 performs switching, controlling operations for the automatic operation, the manual operation, the air flow, the timer clock, and has operation buttons 15, 16, and display portions 17, 18 on it. A filter holding portion 19 is used to hold the filters 1, 2 and to permit their removal together from the case 8. The central portion of the gas sensor 10 is shown in FIG. 3. The electric resistance between two electrodes 20 changes when various types of gases such as methane, aldehyde, ammonia, alcohol, mercaptan, propane and so on arrive at semiconductor 19 such as ZnO, $SnO_2$ or the like, so as to enable the sensor to detect the existence of the gas and its concentration. As the semiconductor 19 is required to be normally kept at a high temperature, it is heated by a heater 21. In the actual use, a protective cover (not shown), mounting-leg portions (not shown) and so on, may be provided. Also, the ultraviolet-ray sensor 9 mainly absorbs wavelengths of 200 through 300 nm ($10^{-6}$ m). When the ultraviolet light hr of approximately 200 nm passes through the ultraviolet glass or quartz glass 22 and reaches two nickel-electrodes 23 across which a direct current of 200 through 400 V has been fed, the discharging operation starts and the current flows between the electrodes 23, which detects the existence of the ultraviolet light. The ultraviolet sensor 9 is externally exposed directly through the hole 8*a* of the front face of the case 8. A concrete example will be described hereinafter with reference to two sensors 9,10. The output of the gas sensor 10 becomes I at a high concentration, II at an intermediate concentration, and III at a low concentration in accordance with the gas concentration, as shown in FIG. 5, to respectively cause a resistance change between the electrodes 20, and the changes are processed in the circuit. On the other hand, the ultraviolet light sensor 9 outputs pulse signals as at IV for the ultraviolet light coming from the flames of gas lighters or the like. The signals IV are transmitted from the ultraviolet light sensor 9 almost immediately (within a few minutes) at a time point C when a lighter has been ignited to light a cigarette. This signal IV turns on the motor 6 of the air cleaner to start the operation of the fan 7. On the other hand, the main smoke flows and auxiliary smoke flows to be produced from the cigarettes gradually increase (I, II, III) the concentration of cigarette smoke depending on cigarette-smoking frequency, room size, wind direction and so on.

Although the signal IV disappears at a time point J when the flame of the lighter disappears, some time is taken while the gas reaches the gas sensor 10 from the gas concentration of the object or while the concentration increases to gradually increase the output of the gas sensor 10. A description will be given in the example of the pattern I with the gas concentration being high. It is possible to automatically turn on the fan 7 with a low flow at a point C, change the flow further into mild flow by the apparatus at the time of occurrence of an output voltage A at point D, furthermore to change the mild flow into the strong flow at a point E (output signal b) when the concentration is increased. The means for stopping the driving operation of the fan 7 will be described hereinafter. As the cleaning operation of the air is performed, the gas concentration is gradually lowered, and detection of the concentration reduction is performed. Namely, the driving operation of the fan 7 is suspended by the transmission of the off signal at a time point (the point H) of the output signal c.

On the other hand, in the case of an intermediate concentration of gas, the signal of the ultraviolet-ray sensor 9 is received as shown in the pattern II to turn on at a point C the weak flow, thereafter the flow changes into the mild flow from the weak flow at the output time point (the point F) of signal a. However, because the output does not rise as far as the output b, the flow does not become the strong flow. The tuning off operation is effected at a time point (the point G) when the cleaning operation is performed to lower the output to the output c.

Figure 6:
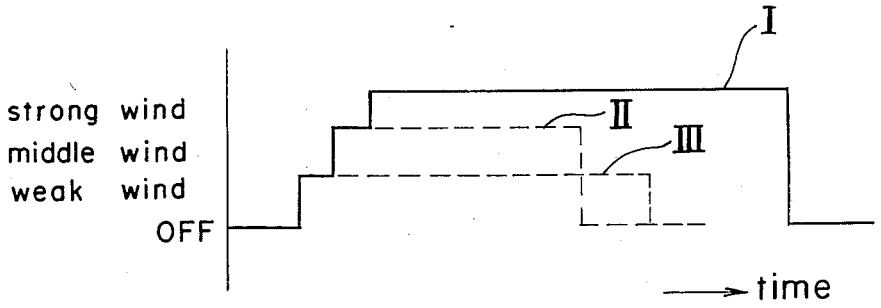
FIG. 6 is a chart showing an example of the operation of the fan.

In the case of the low concentration, the output a is not provided, as in the pattern III. Thus, the flow remains weak from the C point where the signal of the ultraviolet-ray sensor 9 has been received to the i time point predetermined by the timer or the like so as to perform the turn off operation. The example of the operations of the patterns I through III is shown in FIG. 6.

Also, when the signal of the ultraviolet-ray sensor 9 is not provided (when the flame is hidden upon lighting the cigarette), the fan 7 is driven if the output of the gas sensor 10 is higher than the output a. At a time point (the point G or H) when the output has reached the output of level c, the turning off operation is performed.

The other embodiment of the present invention will be described hereinafter. The output of the gas sensor 10 is proportional to the gas concentration, the gas concentration is likely to decrease in the relation to the strength (strong, mild, weak) of the flow produced by the fan 7 and the deodorizing time. Accordingly, as a means for stopping the driving operation of the fan 7, the off signal may be transmitted through a timer function independently of the attenuation of the output of the gas sensor 10 after the time X (for example, 40 minutes) equivalent to the approximate H point from the E point being set where the output of the gas sensor 10 has become level b, the time Y (for example, 20 minutes) equivalent to the approximate G point from the F point being set if the output remains at level a, the time Z (for example, 30 minutes) being set as in the former embodiment unless the output reaches the level a, the predetermined time being set. It is to be noted that the circuit is formed of an ordinary microcomputer-processing control circuit in any embodiment.

Figure 7:
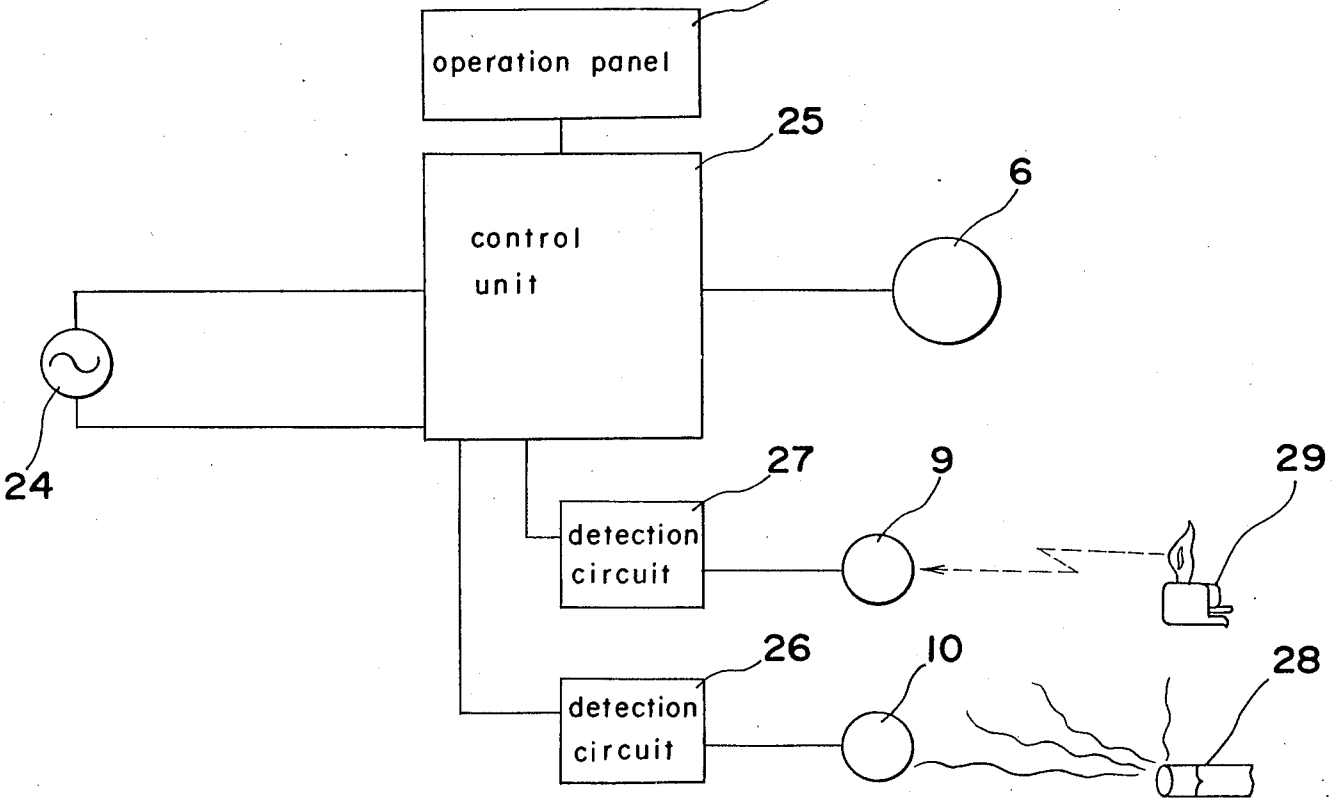
FIG. 7 is a block diagram of a control circuit.

A circuit will be briefly described with reference to FIG. 7. A control unit 25 connected with the power supply 24 receives the signal from the operation panel 14 to drive the motor 6. When the operation is set into automatic operation, the output from the gas sensor 10 is inputted into the control unit 25 through the detecting circuit 26, the output from the ultraviolet-ray sensor 9 is inputted into the controlling apparatus 25 through the detecting circuit 27, so that the control unit 25 automatically drives the motor 6 in accordance with each of the inputs. The gas sensor 10 is adapted to mainly detect the smoke of the cigarette 28 during the smoking or gas components, while the ultraviolet-ray sensor is adapted to detect the flames of the lighter 29 used for lighting the cigarette. It is to be noted that the control unit 25 has a means for stopping the operation of the fan 7 after the air cleaning operation. As described hereinabove, it is adapted to stop the appliance after the air cleaning operation. Also, it is needless to say that gas sensors 10 and ultraviolet-ray sensors 9 other than ones constructed in accordance with the embodiment may be used.

As is clear from the foregoing description, according to the present invention, the ultraviolet-ray sensor and the gas sensor are jointly used to combine the characteristics, so that the operation of the appliance becomes extremely smooth. The appliance operates almost immediately especially when the signal from a light is received. If a cigarette is lighted, for example, indoors, the air cleaning machine operates immediately to clean the air, so that the user may actually feel it. When the gas occurs even under the circumstance where the ultraviolet ray does not reach the ultraviolet sensor, the normal operation is performed, thus allowing the automatic operation to be effected. Accordingly, the clean air is normally provided under the optimum circumstance.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An air cleaning machine comprising:

a filter portion;

a fan means adjacent said filter portion for passing air through said filter portion;

an ultraviolet ray sensor arranged to detect ultraviolet rays produced from flames and produce an output signal in response to such detection; and a control means to which said ultraviolet ray sensor is connected for receiving the output signal from said ultraviolet ray sensor and which is connected to said fan means for controlling the operation of said fan means in response to said output signal.

2. An air cleaning machine as claimed in claim 1 wherein said machine has a front face, and said ultraviolet ray sensor is on said front face of said machine.

3. An air cleaning machine as claimed in claim 1 further comprising a gas sensor which detects the existence of a gas in the atmosphere and produces a further output signal in response to such detection, said gas sensor being connected to said control means so as to supply said further output signal thereto for controlling the operation of said fan means in response to said further output signal.

4. An air cleaning machine as claimed in claim 3 in which said control means includes means for stopping the operation of said fan means.

5. An air cleaning machine as claimed in claim 4 in which said gas sensor is a gas sensor which produces a further output signal having a value corresponding to the concentration of the gas being detected, and said means for stopping the operation of said fan means comprises means for, when only an output signal from said ultraviolet ray sensor is received, stopping the operation of said fan means after a predetermined time, and for, when the further output signal from said gas sensor is received while said fan means is operating in response to an output signal from said ultraviolet ray sensor, stopping the driving operation of said fan means after a predetermined time from the time said further output signal from said gas sensor is received in accordance with the value of said further output signal.

6. An air cleaning machine as claimed in claim 4 in which said means for stopping the driving operation of said fan means comprises means for stopping the driving operation after a predetermined time.

7. An air cleaning machine as claimed in claim 4 wherein said gas sensor is a gas sensor which produces a further output signal having a value corresponding to the concentration of the gas being detected, and said means for stopping the driving operation of said fan means comprises means for stopping the driving operation when said further output signal drops below a predetermined value.

8. An air cleaning machine as claimed in claim 1 in which said control means includes means for stopping the operation of said fan means.

9. An air cleaning machine as claimed in claim 8 in which said means for stopping the driving operation of said fan means comprises means for stopping the driving operation after a predetermined time.

* * * * *